US009719462B2

(12) United States Patent
Lavazza

(10) Patent No.: US 9,719,462 B2
(45) Date of Patent: Aug. 1, 2017

(54) CYLINDER BLOCK FOR AN INTERNAL COMBUSTION ENGINE

(71) Applicant: GM GLOBAL TECHNOLOGY OPERATIONS LLC, Detroit, MI (US)

(72) Inventor: Paolo Lavazza, Turin (IT)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 71 days.

(21) Appl. No.: 14/699,539

(22) Filed: Apr. 29, 2015

(65) Prior Publication Data

US 2016/0319771 A1 Nov. 3, 2016

(51) Int. Cl.
*F02F 7/00* (2006.01)
*F02F 1/16* (2006.01)

(52) U.S. Cl.
CPC ..... *F02F 7/0021* (2013.01); *F02F 1/16* (2013.01); *F02F 7/00* (2013.01); *F02F 7/0007* (2013.01)

(58) Field of Classification Search
CPC ..... F02F 7/0021; F02F 7/0065; F02F 1/16; F02F 7/00; F02F 7/0012
See application file for complete search history.

(56) References Cited

U.S. PATENT DOCUMENTS

| | | | | |
|---|---|---|---|---|
| 4,903,646 | A | 2/1990 | Minagawa et al. | |
| 5,070,830 | A * | 12/1991 | Malven | B60K 17/00 123/195 A |
| 5,247,915 | A * | 9/1993 | Sasada | F02F 7/0007 123/195 C |
| 7,077,095 | B2 | 7/2006 | Hada et al. | |

FOREIGN PATENT DOCUMENTS

| | | | |
|---|---|---|---|
| DE | 19630287 | A1 | 1/1998 |
| DE | 10021221 | C1 | 5/2001 |
| JP | H02102351 | A | 4/1990 |
| JP | 2002115602 | A | 4/2002 |
| JP | 2004156520 | A | 6/2004 |

* cited by examiner

*Primary Examiner* — Kevin Lathers
(74) *Attorney, Agent, or Firm* — Lorenz & Kopf LLP

(57) ABSTRACT

A cylinder block for an internal combustion engine includes a network structure projecting from a sidewall thereof. The network structure is formed by a plurality of ribs including a first group of parallel ribs extending in a first diagonal direction with respect to an axis of a cylinder, a second group of parallel ribs extending in a second diagonal direction with respect to the axis of the cylinder, and a third group of parallel transverse ribs intersecting the diagonal ribs in such a way to form a triangular arrangement of ribs. The network structure further includes cylindrical portions in correspondence of the vertices of the triangular arrangement of ribs.

18 Claims, 5 Drawing Sheets

CYLINDER BLOCK FOR AN INTERNAL COMBUSTION ENGINE

TECHNICAL FIELD

The present disclosure pertains to a cylinder block for an internal combustion engine.

BACKGROUND

Internal combustion engines (ICE) for motor vehicles generally include a cylinder block that defines at least one cylinder accommodating a reciprocating piston coupled to rotate a crankshaft. The cylinder is closed by a cylinder head that cooperates with the reciprocating piston to define a combustion chamber. A fuel and air mixture is cyclically drawn into the combustion chamber and ignited, thereby generating hot expanding exhaust gasses that cause the reciprocating movements of the piston. Cylinder blocks of internal combustion engines are subjected to high bending and torsion forces and therefore an improved strength and rigidity of the block is desired.

A known cylinder block has a series of diagonal ribs on its sidewalk, the diagonal ribs crossing each other at an angle with respect to an axial direction defined by a crankshaft. In the known cylinder block, a first group of diagonal ribs is provided, each rib of the first group ranging from a position approximately corresponding to a cylinder partition wall at the upper part of the side wall of the cylinder block to a position approximately corresponding to a cylinder center in a lower portion of the cylinder block approximately corresponding to the base of a cylinder. A second group of diagonal ribs is provided, each rib of the second group of ribs ranging from a position approximately corresponding to the cylinder center at the upper part of the side wall of the cylinder block to a position approximately corresponding to the base of a cylinder, the diagonal ribs of the second group being inclined in a different direction with respect of the diagonal ribs of the first group.

A transverse rib is also provided so that it may intersect in points where the ribs of the first and of the second group intersect forming a triangular pattern composed of isosceles triangles. Internally to some of the triangles of the triangular pattern, in positions corresponding to the cylinder partitions, couples of cylindrical portions are provided.

SUMMARY

The present disclosure represents an improved structural integrity of known cylinder blocks for internal combustion engines. This and other desirable features and characteristics will become apparent from the subsequent summary and detailed description, and the appended claims, taken in conjunction with the accompanying drawings and this background.

An embodiment of the present disclosure provides a cylinder block fir an internal combustion engine, which includes a network structure, projecting from a sidewall thereof. The network structure includes a plurality of ribs, including a first group of parallel ribs extending in a first diagonal direction with respect to an axis of a cylinder, a second group of parallel ribs extending in a second diagonal direction with respect to the axis of the cylinder, and a third group of parallel transverse ribs intersecting the diagonal ribs in such a way to form a triangular arrangement of ribs.

The network structure also includes cylindrical portions in correspondence of the vertices of the triangular arrangement of ribs.

An advantage of this embodiment is that the network structure including a pattern of ribs projecting from the external surfaces of the cylinder block allows for an improved rigidity of the whole cylinder block, while at the same avoiding an increase in overall weight. Furthermore, the network structure of the above embodiment of the present disclosure configures a direct link between important structural nodes of the cylinder block.

According to another embodiment of the present disclosure, the network structure extends from a deck face of the cylinder block to a sump face thereof. An advantage of this embodiment is that the network structure allows for an improved strength of the whole cylinder block including the volume that encloses the crankshaft.

According to another embodiment of the present disclosure, the triangles of the network structure are substantially equilateral triangles. An advantage of this embodiment is that if provides a regular structure, namely a regular patterned structure enclosing the cylinders of the engine improving strength of the cylinder block.

According to another embodiment of the present disclosure, the network structure is integrally formed in the cylinder block by casting. An advantage of this embodiment is that the network structure can benefit from an improved casting process by linking directly top, bottom, rear and front of the mold flow.

According to another embodiment of the present disclosure, the diagonal ribs extend from a position substantially facing holes for cylinder head screws. An advantage of this embodiment is that the network structure provides a link for strengthening the area between the cylinder block and the cylinder head.

According to another embodiment of the present disclosure, at least one of the transverse ribs intersects the diagonal ribs in correspondence of the lower portion of a water jacket of the cylinders and is provided with cylindrical portions in the intersections. An advantage of this embodiment is that network structure provides a link for strengthening the area of transition between the water jacket and the lower portion of the cylinders and the cylindrical portions may be used for outlets of the water jacket or for other uses, such as seats for sensors.

According to another embodiment of the present disclosure, at least one of the transverse ribs intersects the diagonal ribs in correspondence of a crankcase containing a crankshaft and is provided with cylindrical portions in the intersections. An advantage of this embodiment is that the cylindrical portions can be configured to project into the interior of the cylinder block up to reach the crankcase.

According to another embodiment of the present disclosure, at least one the transverse ribs intersect the diagonal ribs in correspondence of a crankshaft axis and is provided with cylindrical portions in the intersections. An advantage of this embodiment is that it gives continuity to the network structure improving the performance of the cylinder block in terms of Noise, Vibration and Harshness (NVH).

According to another embodiment of the present disclosure, the diagonal ribs extend to a position substantially facing holes for sump screws. An advantage of this embodiment is that the network structure provides a link for strengthening the area between the cylinder block and a sump flange underneath the cylinder block.

Still another embodiment of the present disclosure provides an internal combustion engine including a cylinder block. The advantages of this embodiment are substantially the same of the cylinder block.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the present disclosure or the present disclosure and uses of the present disclosure. Furthermore, there is no intention to be bound by any theory presented in the preceding background of the present disclosure or the following detailed description. Preferred embodiments will now be described with reference to the enclosed drawings.

Figure 1:
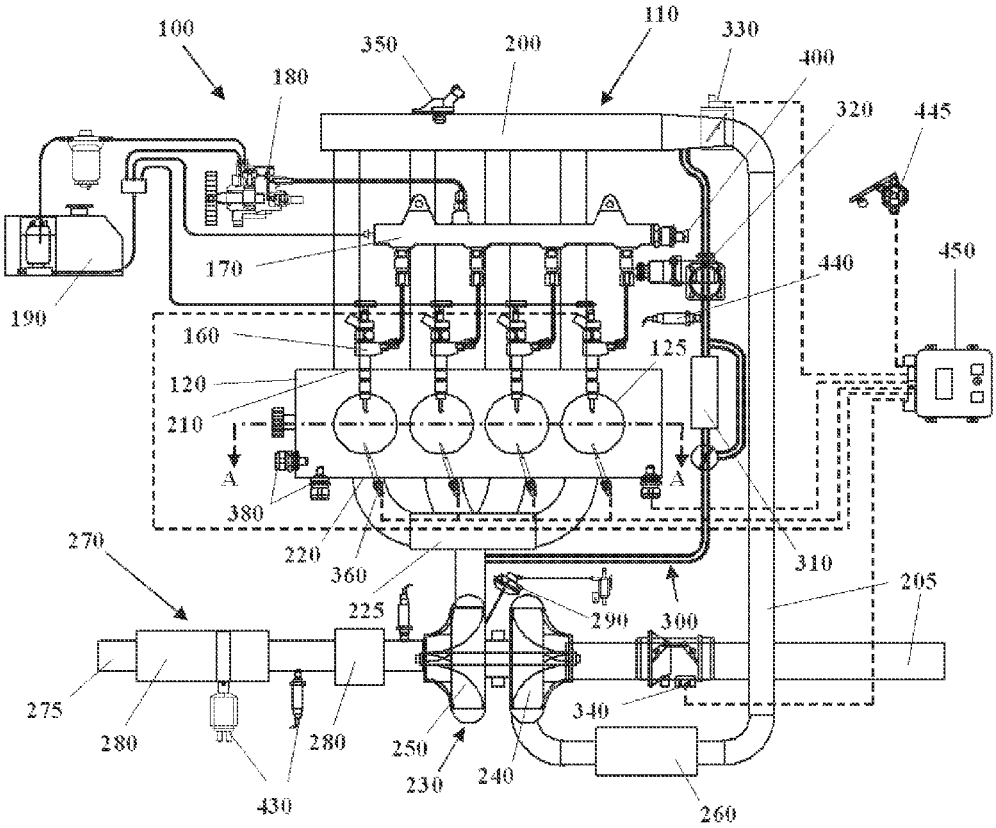
FIG. 1 shows an automotive system.
Figure 2:
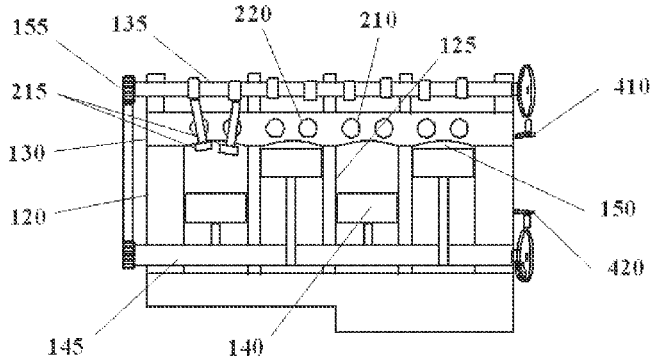
FIG. 2 is a cross-section of an internal combustion engine belonging to the automotive system of FIG. 1.

Some embodiments may include an automotive system 100, as shown in FIGS. 1 and 2 that includes an internal combustion engine (ICE) 110 having an engine block 120 defining at least one cylinder 125 having a piston 140 coupled to rotate a crankshaft 145, the crankshaft 145 being housed in a crank case. A cylinder head 130 cooperates with the piston 140 to define a combustion chamber 150. A fuel and air mixture (not shown) is drawn into the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high-pressure fuel pump 180 that increase the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. An intercooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move the vanes to alter the flow of the exhaust gases through the turbine 250. In other embodiments, the turbocharger 230 may be fixed geometry and/or include a waste gate.

The exhaust system 270 may include an exhaust pipe 275 having one or more exhaust after-treatment devices 280. The after-treatment devices may be any type of device configured to change the composition of the exhaust gases. Some examples of after-treatment devices 280 include, but are not limited to, catalytic converters (two and three way), oxidation catalysts, lean $NO_x$ traps, hydrocarbon adsorbers, selective catalytic reduction (SCR) systems, and particulate filters. Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

The automotive system 100 may further include an electronic control unit (ECU) 450 in communication with one or more sensors and/or devices associated with the ICE 110. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal position sensor 445. Furthermore, the ECU 450 may generate output signals to various control devices that are arranged to control the operation of the ICE 110, including, but not limited to, the fuel injectors 160, the throttle body 330, the EGR Valve 320, the VGT actuator 290, and the cam phaser 155. Note, dashed lines are used to indicate communication between the ECU 450 and the various sensors and devices, but some are omitted for clarity.

Turning now to the ECU 450, this apparatus may include a digital central processing unit (CPU) in communication with a memory system, or data carrier, and an interface bus. The CPU is configured to execute instructions stored as a program in the memory system, and to send and receive signals to/from the interface bus. The memory system may include various storage types including optical storage, magnetic storage, solid-state storage, and other non-volatile memory. The interface bus may be configured to send, receive, and modulate analog and/or digital signals to/from the various sensors and control devices. The program may embody the methods disclosed herein, allowing the CPU to carryout out the steps of such methods and control the ICE 110.

The program stored in the memory system is transmitted from outside via a cable or in a wireless fashion. Outside the automotive system 100 it is normally visible as a computer program product, which is also called computer readable medium or machine readable medium in the art, and which should be understood to be a computer program code residing on a carrier, said carrier being transitory or non-transitory in nature with the consequence that the computer program product can be regarded to be transitory or non-transitory in nature.

An example of a transitory computer program product is a signal, e.g. an electromagnetic signal such as an optical signal, which is a transitory carrier for the computer program code. Carrying such computer program code can be achieved by modulating the signal by a conventional modulation technique such as QPSK for digital data, such that binary data representing said computer program code is impressed on the transitory electromagnetic signal. Such signals are e.g. made use of when transmitting computer program code in a wireless fashion via a WiFi connection to a laptop.

In case of a non-transitory computer program product, the computer program code is embodied in a tangible storage medium. The storage medium is then the non-transitory carrier mentioned above, such that the computer program code is permanently or non-permanently stored in a retrievable way in or on this storage medium. The storage medium can be of conventional type known in computer technology such as a flash memory, an Asic, a CD or the like.

Instead of an ECU 450, the automotive system 100 may have a different type of processor to provide the electronic logic, e.g. an embedded controller, an onboard computer, or any processing module that might be deployed in the vehicle.

Figure 3:
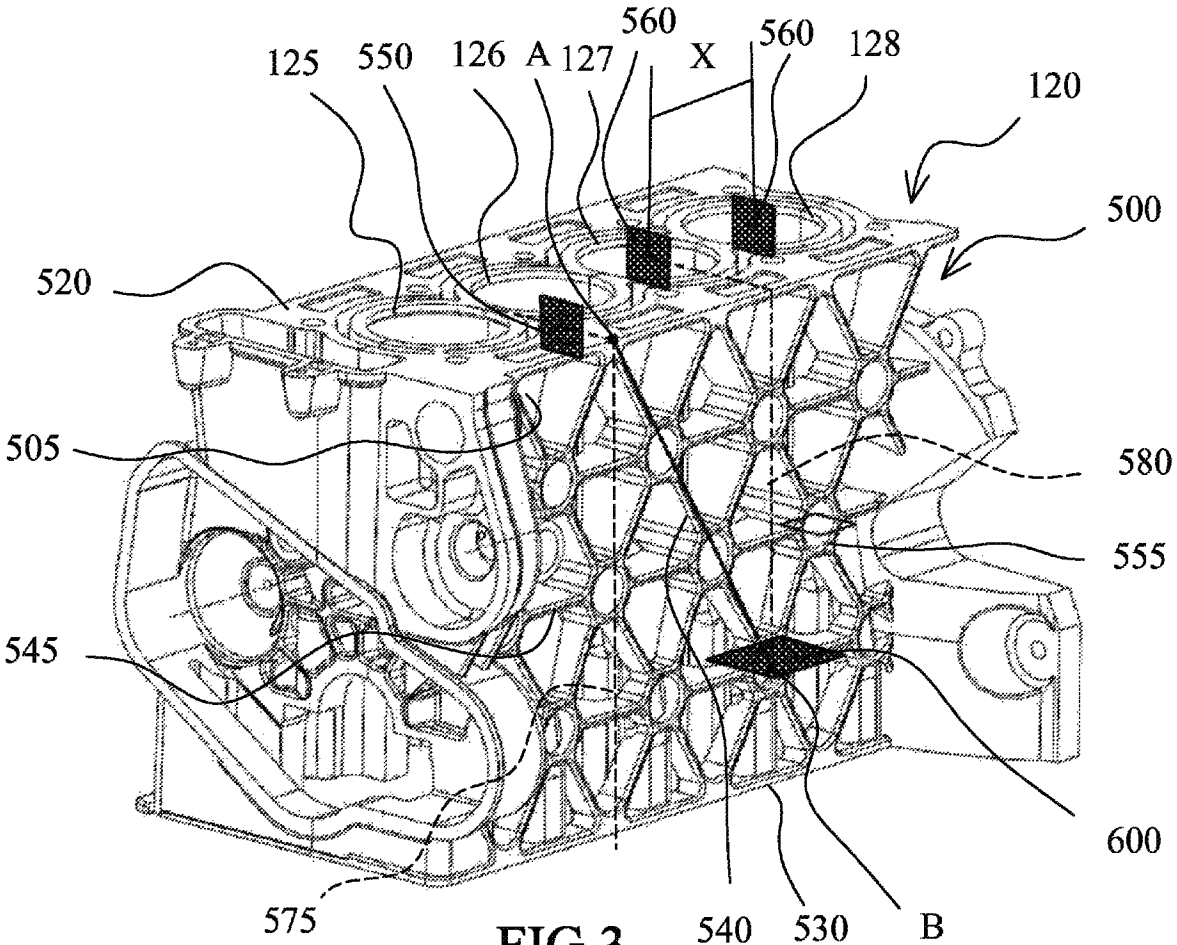
FIG. 3 is a first view of a cylinder block according to an embodiment of the present disclosure.
Figure 4:
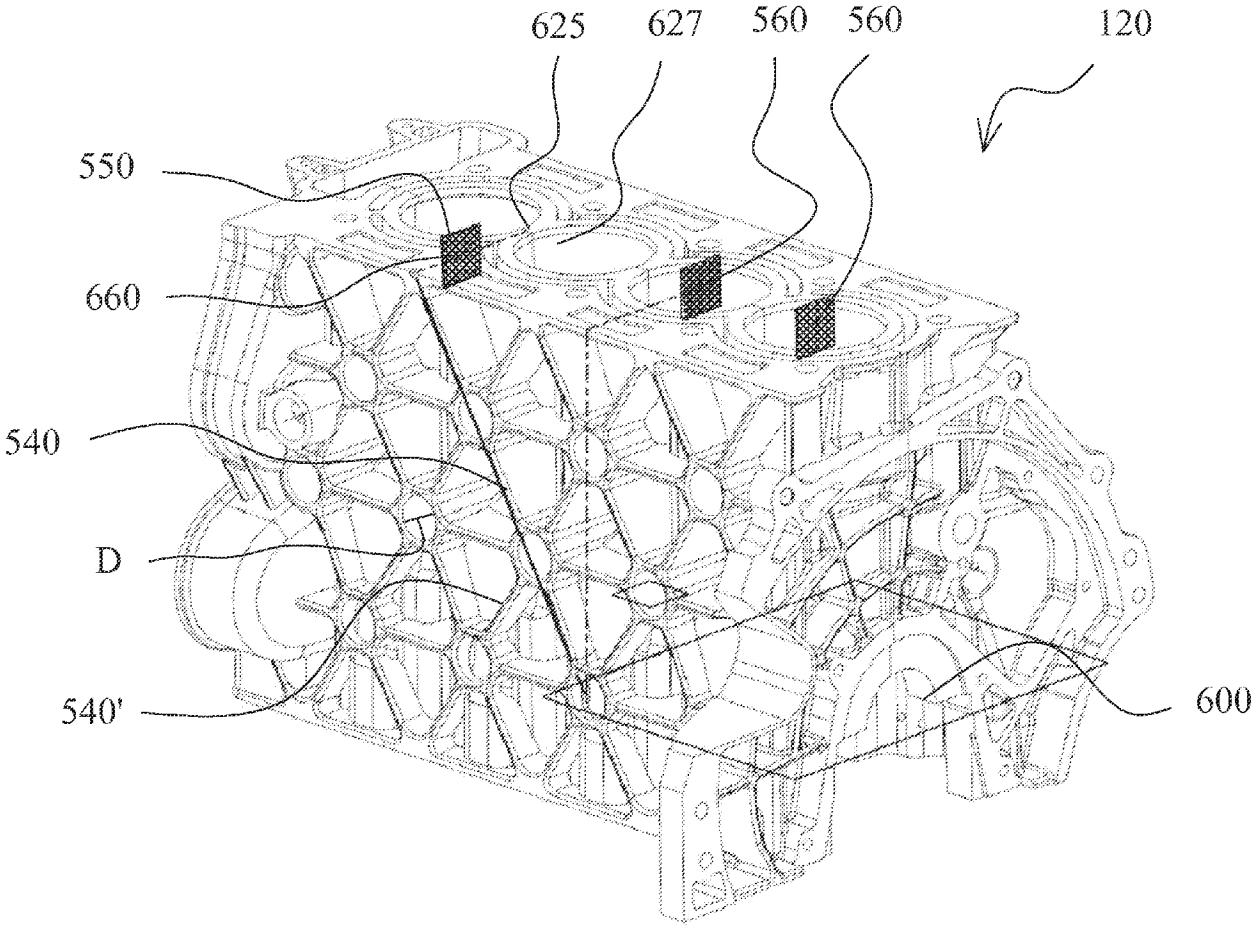
FIG. 4 is a second view of a cylinder block according to an embodiment of the present disclosure.

FIG. 3 is a first view of a cylinder block 120 according to an embodiment of the present disclosure. The cylinder block 120 of FIG. 3 defines the space for a plurality of cylinder bores 125-128 (in the example four cylinder bores), each of the cylinder bores 125-128 being separated from an adjacent cylinder bore by a cylinder partition 625 (FIG. 4), each cylinder partition 625 being formed by the thickness of two adjacent cylinder walls 627. The cylinder block 120 also includes sidewalk 505, a deck face 520 and a sump face 530. The cylinder block 120 also defines the space for a crankshaft 145 that is rotated by the piston 140 (not represented in FIG. 3 for simplicity).

A network structure 500 projecting from the side walls 505 and including a plurality of ribs 540,540' and 545 is integrally provided on the external surfaces of the side walls 505 of the cylinder block 120. The cylinder block 120 including the network structure 500 can be integrally formed, for example, by casting. The network structure 500 is designed to improve the structural stability and the strength of cylinder block 120. The network structure 500 includes a first group of diagonal ribs 540 that are parallel to each other and spaced equally from each other and a second group of parallel diagonal ribs 540' inclined in the opposite direction with respect to the diagonal ribs 540 of the first group and also spaced equally from each other. Some diagonal ribs 540,540' of the network structure 500 extend from the deck face 520 to the sump face 530 of cylinder block 120 forming a regular pattern.

Furthermore, the network structure 500 includes a plurality of transverse ribs 545 that connect both groups of diagonal ribs 540,540', forming a modular configuration, namely a triangular arrangement including a plurality of triangles. Preferably, the triangles of the network structure 500 are substantially equilateral triangles.

The network structure 500 includes cylindrical portions 555 in correspondence of some of the vertices of the triangles. In cylinder block 120 of FIG. 3, a distance X is also represented, the distance X being the distance between planes 560 that contain the axis of two consecutive cylinder bores, for example cylinder bores 127,128. In FIG. 3 plane 550 dividing two adjacent cylinders and containing the holes for the cylinder head 130 screw is also represented. A rib 540 of the network structure 500 is represented in FIG. 3 with reference to points A and B whose significance will be better explained in the following description with special reference to FIGS. 6-8.

Furthermore, a trace 580 on the network structure 500 of plane 560 and a trace 575 on the network structure 500 of plane 550 are represented in FIG. 3, in order to define reference axis for the pattern 500.

Figure 5:
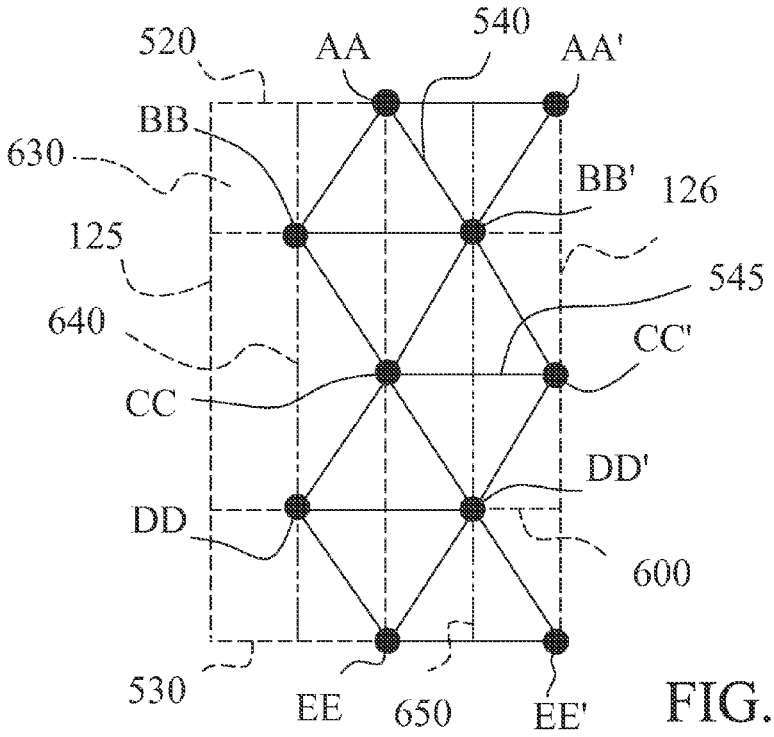
FIG. 5 is a schematic representation of a portion of a pattern of ribs on a cylinder block according to an embodiment of the present disclosure.

FIG. 5 is a schematic representation of a portion of the network structure 500 on cylinder block 120, according to an embodiment of the present disclosure. Adjacent cylinder bores 125,126 are represented in dotted lines, as well as their respective axis 640,650. In FIG. 5, for the sake of better understanding of the various embodiments of the present disclosure, the network structure 500 is represented schematically as formed by a plurality of vertices of a triangular arrangement, the vertices resulting by the intersection of diagonal ribs 540,540' and transverse ribs 545.

A first group of vertices AA, AA' is located at an height corresponding to the deck face 520, whereby in vertex AA ribs 540,540' intersect the deck face 520 in a position facing holes 660 for cylinder head 130 screws (not represented for simplicity) for cylinder 125. In a similar fashion, in vertex AA', ribs 540,540' intersect the deck face 520 in a position facing holes 660 for cylinder head 130 screws for cylinder 126. In vertex BB and BB', ribs 540,540' intersect each other and transverse rib 545 in a position corresponding to a lower portion of a water jacket 630 of the cylinder block 120. Vertex CC and CC' are located in correspondence of a crank case 595 containing the crankshaft 145 and are provided with cylindrical portions 555 in the intersections. Vertices DD, DD' are positioned at the same height of the crankshaft axis 600. Finally, in vertex EE, ribs 540,540' intersect in a position facing holes for sump screws for cylinder 125 and, in vertex EE', ribs 540,540' intersect in a position facing holes for sump screws for cylinder 126.

Figure 6:
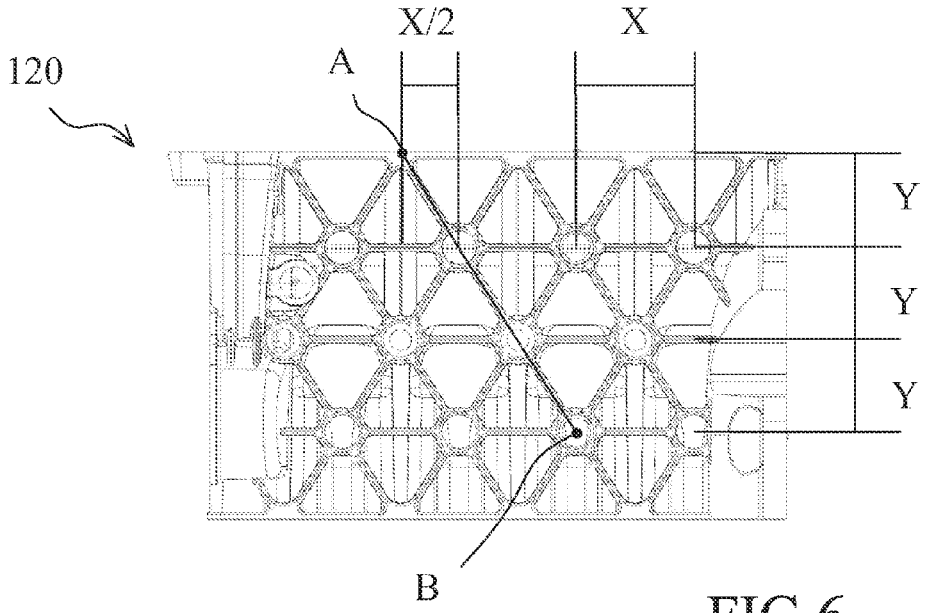
FIG. 6 represents a step of a procedure suitable for designing a pattern of ribs applicable to a cylinder block according to an embodiment of the present disclosure.
Figure 7:
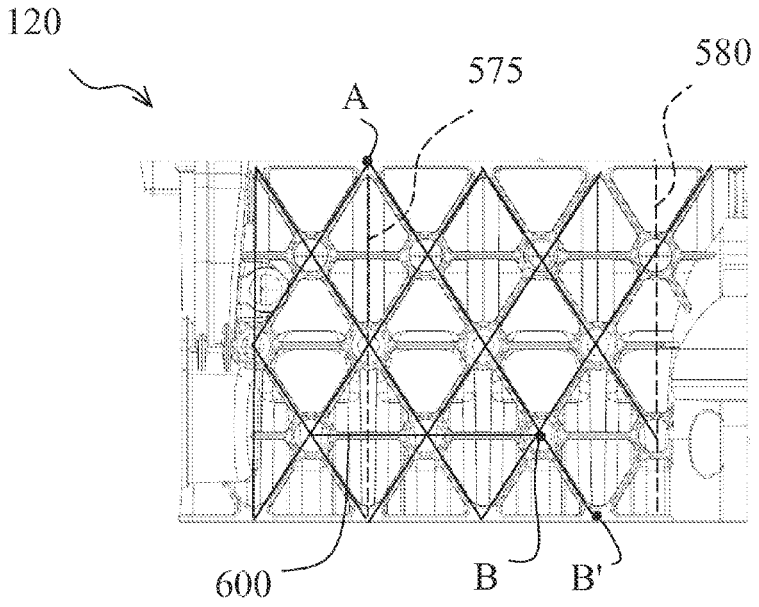
FIG. 7 represents another step of the procedure suitable for designing a pattern of ribs applicable to a cylinder block according to an embodiment of the present disclosure.
Figure 8:
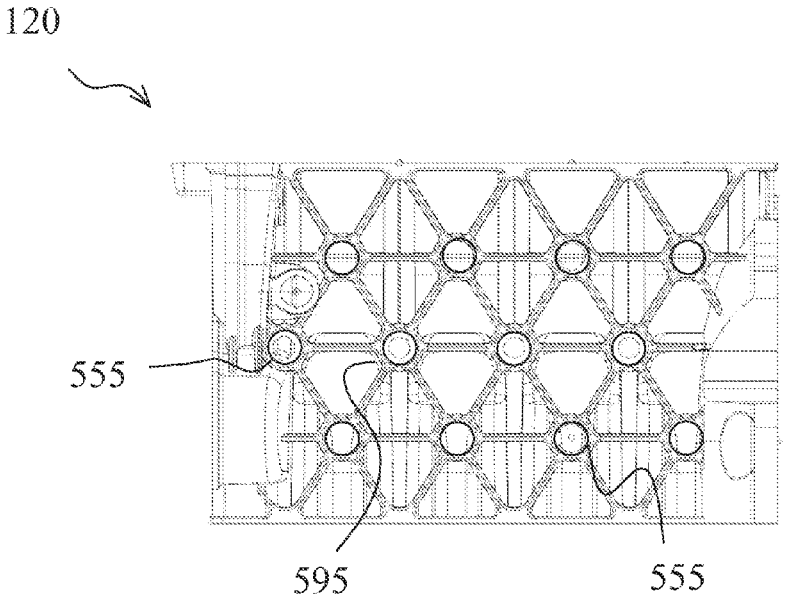
FIG. 8 represents a further step of the procedure suitable for designing a pattern of ribs applicable to a cylinder block according to an embodiment of the present disclosure.

In order to better appreciate the various embodiments of the present disclosure, reference is now made to FIGS. 6-8, which represent steps of a procedure suitable for designing the network structure 500 of cylinder block 120. A first step of the procedure (FIG. 6) provides the definition of the distance X between planes 560 that contain the axis of two consecutive cylinder bores, namely a bore to bore distance. Also, a distance X/2 is defined from each single bore center to plane 550 that intersects point A. A distance Y is also defined, the distance Y being one third of the distance between deck face 520 of the cylinder block 120 and crankshaft axis 600. A rib 540 is designed starting from point A in the same plane 550 that intersects the space between two consecutive cylinder bores to a point B which is on a plane 560 that contain the axis of an adjacent cylinder bore and is at the same height of the crankshaft axis 600.

In a second step of the procedure (FIG. 7), the rib 540 is then extended in the same direction defined by the points A and B up to a point B' in correspondence of a sump face 530 of the cylinder block 120. The rib 540 is then mirrored with respect to the axis 575 and is multiplied in both directions and the crossing points of diagonal ribs 540 are linked by transverse ribs 545.

A third step of the procedure (FIG. 8) includes the design of cylindrical portions 555 in the crossing points between diagonal ribs 540 and the transverse ribs 545. However, cylindrical portions 555 are not provided in positions where ribs 540,540' intersect the deck face 520 and in positions where 540,540' intersect the sump face 530. Each cylindrical portion 555 may have a circular internal surface or a surface of other form, such as a hexagonal form. The diameter D of the cylindrical portions 555 located in correspondence of a crankcase containing the crankshaft 145 may be greater of the width of the bearings of the crankshaft 145. A preferred ratio between diameter D and Bearing Width is D=Bearing Width/0.7. This ratio defines a correct proportion to allow the cylindrical portions 555 to reach the crankcase 595. For example Bearing Width may be 21 mm and cylindrical portion Diameter may therefore be 30 mm. These values are merely exemplificative and not limitative of the various embodiments of the present disclosure since other automotive systems may have different values.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the present disclosure in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the present disclosure as set forth in the appended claims and their legal equivalents.

What is claimed is:

1. A cylinder block for an internal combustion engine, the cylinder block having a sidewall defining a cylinder and a network structure projecting from the sidewall, the network structure comprising:

a plurality of first diagonal ribs extending parallel to one another and in a first diagonal direction with respect to an axis of the cylinder;

a plurality of second diagonal ribs extending parallel to one another and in a second diagonal direction with respect to the axis of the cylinder;

a plurality of transverse ribs extending parallel to one another and intersecting the first and second diagonal ribs to form a triangular arrangement of ribs; and a cylindrical portion formed at at least one vertex formed by the plurality of transverse ribs intersecting the first and second diagonal ribs, wherein the cylinder block comprises a deck face and a sump face, and wherein the network structure extends from the deck face to the sump face.

2. The cylinder block according to claim 1, wherein the triangles of the network structure are equilateral triangles.

3. The cylinder block according to claim 1, wherein the network structure comprises a cast structure integrally formed in the cylinder block.

4. The cylinder block according to claim 1, wherein at least one of the first and second diagonal ribs extend from a position facing holes formed in the cylinder block configured to receive cylinder head screws.

5. The cylinder block according to claim 1, wherein the cylinder block further comprises a water jacket of the cylinder, and wherein at least one of the transverse ribs intersects at least one of the first and second diagonal ribs in a lower portion of the water jacket of the cylinders and is provided with a cylindrical portion in the intersection.

6. The cylinder block according to claim 1, wherein the cylinder block further comprises a crankcase configured to receive a crankshaft, and wherein at least one of the transverse ribs intersects at least one of the first and second diagonal ribs on the crankcase and is provided with a cylindrical portion in the intersection.

7. The cylinder block according to claim 1, wherein the cylinder block further comprises a crankcase configured to receive a crankshaft, wherein the crankcase defines a crankshaft axis, and wherein at least one of the transverse ribs intersects at least one of the first and second diagonal ribs in correspondence to the crankshaft axis and is provided with a cylindrical portion in the intersection.

8. The cylinder block according to claim 1, wherein at least one of the first and second diagonal ribs extends to a position facing holes formed in the cylinder block configured to receive sump screws.

9. An internal combustion engine comprising a cylinder block according to claim 1.

10. A cylinder block for an internal combustion engine, the cylinder block having a sidewall defining a cylinder and a network structure projecting from the sidewall, the network structure comprising:

a plurality of first diagonal ribs extending parallel to one another and in a first diagonal direction with respect to an axis of the cylinder;

a plurality of second diagonal ribs extending parallel to one another and in a second diagonal direction with respect to the axis of the cylinder;

a plurality of transverse ribs extending parallel to one another and intersecting the first and second diagonal ribs to form a triangular arrangement of ribs; and a cylindrical portion formed at at least one vertex formed by the plurality of transverse ribs intersecting the first and second diagonal ribs, wherein the cylinder block further comprises a crankcase configured to receive a crankshaft, wherein the crankcase defines a crankshaft axis, and wherein at least one of the transverse ribs intersects at least one of the first and second diagonal ribs in correspondence to the crankshaft axis and is provided with a cylindrical portion in the intersection.

11. The cylinder block according to claim 10, wherein the cylinder block comprises a deck face and a sump face, and wherein the network structure extends from the deck face to the sump face thereof.

12. The cylinder block according to claim 10, wherein the triangles of the network structure are equilateral triangles.

13. The cylinder block according to claim 10, wherein the network structure comprises a cast structure integrally formed in the cylinder block.

14. The cylinder block according to claim 10, wherein at least one of the first and second diagonal ribs extend from a position facing holes formed in the cylinder block configured to receive cylinder head screws.

15. The cylinder block according to claim 10, wherein the cylinder block further comprises a water jacket of the cylinder, and wherein at least one of the transverse ribs intersects at least one of the first and second diagonal ribs in a lower portion of the water jacket of the cylinders and is provided with a cylindrical portion in the intersection.

16. The cylinder block according to claim 10, wherein the cylinder block further comprise a crankcase configured to receive a crankshaft, and wherein at least one of the transverse ribs intersects at least one of the first and second diagonal ribs on the crankcase and is provided with a cylindrical portion in the intersection.

17. The cylinder block according to claim 10, wherein at least one of the first and second diagonal ribs extends to a position facing holes formed in the cylinder block configured to receive sump screws.

18. An internal combustion engine comprising a cylinder block according to claim 10.

* * * * *